US007021060B1

(12) United States Patent
Kalina

(10) Patent No.: US 7,021,060 B1
(45) Date of Patent: Apr. 4, 2006

(54) POWER CYCLE AND SYSTEM FOR UTILIZING MODERATE TEMPERATURE HEAT SOURCES

(75) Inventor: Alexander I. Kalina, Hillsborough, CA (US)

(73) Assignee: Kaley, LLC, Belmont, CA (US)

( * ) Notice: Subject to any disclaimer, the term of this patent is extended or adjusted under 35 U.S.C. 154(b) by 0 days.

(21) Appl. No.: 11/069,937

(22) Filed: Mar. 1, 2005

(51) Int. Cl.
*F01K 25/06* (2006.01)

(52) U.S. Cl. ..... 60/649; 60/651; 60/671

(58) Field of Classification Search ..... 60/649, 60/651, 653, 671

See application file for complete search history.

(56) References Cited

U.S. PATENT DOCUMENTS 6,058,695 A * 5/2000 Ranasinghe et al. ..... 60/39.182
6,910,334 B1 * 6/2005 Kalina ..... 60/651
6,923,000 B1 * 8/2005 Kalina ..... 60/649
6,941,757 B1 * 9/2005 Kalina ..... 60/649

* cited by examiner

*Primary Examiner*—Hoang Nguyen
(74) *Attorney, Agent, or Firm*—Robert W. Strozier

(57) ABSTRACT

A new thermodynamic cycle is disclosed for converting energy from a moderate temperature stream, external source into useable energy using a working fluid comprising of a mixture of a low boiling component and a higher boiling component and including a higher pressure circuit and a lower pressure circuit. The cycle is designed to improve the efficiency of the energy extraction process by recirculating a portion of a liquid stream prior to further cooling. The new thermodynamic process and system for accomplishing the improved efficiency is especially well-suited for streams from moderate-temperature geothermal sources.

1 Claim, 1 Drawing Sheet

POWER CYCLE AND SYSTEM FOR UTILIZING MODERATE TEMPERATURE HEAT SOURCES

BACKGROUND OF THE INVENTION

1. Field of the Invention

The present invention relates to a thermodynamic cycle and an apparatus for implementing the thermodynamic cycle for converting a portion of thermal energy associated with superheated stream of a multi-component fluid in a high efficient manner.

More particularly, the present invention relates to a thermodynamic cycle and an apparatus for implementing the thermodynamic cycle for converting a portion of thermal energy associated with superheated stream of a multi-component fluid in a high efficient manner, where the cycle utilizes four different compositions of the multi-component fluid and heats, vaporizes three of the compositional streams and superheats one of the compositional streams to form the superheated stream from which useable energy is produced. The cycle is designed to use with moderate temperature heat source stream.

2. Description of the Related Art

In U.S. Pat. No. 6,769,256, issued Aug. 31, 2004, a system is disclosed which utilizes heat from moderate and low temperature heat sources. This system is presented in three variants ranging from a highest efficiency and highest complexity variant, to a moderate variant, and finally to a lowest efficiency and lowest complexity variant. A detailed calculation of this system demonstrates than when the initial temperature of the heat source exceeds 325–330° F., the high complexity and moderate variants of the system (in which the working fluid is not fully vaporized, and the remaining liquid is recycled) degenerate and are thus in effect converted into the lowest complexity, lowest efficiency variant (in which all working fluid is vaporized).

Although prior systems for improving energy extraction from moderate temperature geothermal or other heat sources have been disclosed, there is still a need in the art for an improved and simplified system for energy extraction from moderate temperature sources.

SUMMARY OF THE INVENTION

The present invention provides an energy extraction apparatus comprising eight heat exchangers, at least three mixers, at least three splitters, two pumps, a separator and a turbine, where the heat exchangers are designed to produce a fully condensed basic working fluid stream and a superheated working fluid stream utilizing an external coolant stream, an external heat source stream and two working fluid streams.

The present invention also provides a method for energy extraction including the steps of

DETAILED DESCRIPTION OF THE INVENTION

Figure 1:
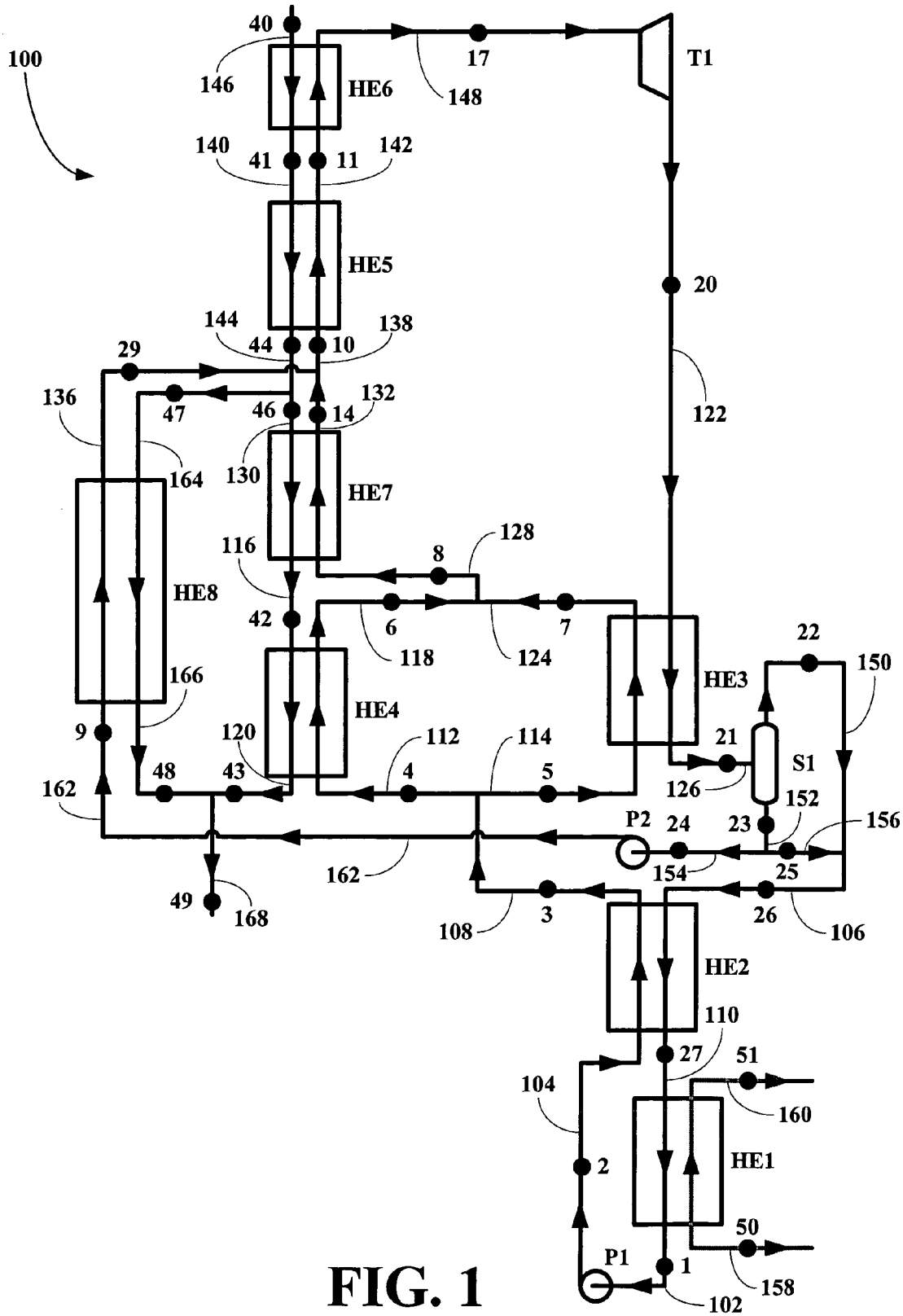
FIG. 1 depicts a flow diagram of a preferred embodiment of a power cycle and system for utilizing moderate temperature heat sources of this invention.

The inventors have found that an improved power cycle and system for utilizing moderate temperature heat sources can be designed. The system has been developed for the purpose of producing useful power from heat sources, such as geothermal fluids, waste heat sources and other similar sources, with a moderate initial temperature, i.e., a temperature between about 325° F. and about 500° F. The inventor has found that the system of this invention has higher efficiency than the systems described in the prior art with heat sources whose initial temperatures are greater than or equal to 325° F.

The proposed system uses, as a working fluid, a multi-component mixture of at least two components with different normal boiling temperatures. In the preferred embodiment of the system, this mixture consists of water and ammonia, but other working fluids, such as a mixture of hydrocarbons, freons or other substances can be used as well.

Referring now to FIG. 1, the power cycle and system, generally 1, is shown. A fully condensed working fluid stream 3 having a high concentration of a low boiling component of a multi-component fluid, hereafter referred to as a basic solution, and having parameters as at a point 1 enters into a pump, P1. The stream 102 is pressurized to a desired higher pressure and becomes a higher pressure stream 5 having parameters as at a point 2. The stream 104 having the parameters as at the point 2 then passes through a recuperative pre-heater or a second heat exchanger HE2, where the stream 104 is heated in counterflow by a returning stream 7 having parameters as at a point 26 of condensing basic solution in a first heat exchange process 26-27 or 2-3 described below. The first heat exchange process 26-27 produces a pre-heated stream 9 having parameters as at a point 3 and a condensed stream 11 having parameters as at a point 27. The parameters of the pre-heated stream 108 correspond to a state of saturated or slightly subcooled liquid.

The pre-heated stream 108 having the parameters as at the point 3 is then divided into two substreams 13 and 15 having parameters as at points 4 and 5, respectively. The basic solution substream 112 having the parameters as at the point 4 passes through a fourth heat exchanger HE4, where it is heated and partially vaporized in counterflow with a fifth heat source fluid stream 17 having parameters as at a point 42 in a second heat exchange process 42-43 or 4-6 as described below. The second heat exchange process 42-43 produces a stream 19 having parameters as at a point 6 and a sixth cooled heat source stream 21 having parameters as at a point 43. The basic solution substream 114 having the parameters as at the point 5 passes through a recuperative boiled-condenser or third heat exchanger HE3, where it is heated and partially vaporized in counterflow with a condensing working fluid stream 23 having parameters as at a point 20 in a third heat exchange process 20-21 or 5-7 as described below. The third heat exchange process 20-21 produces a stream 25 having obtains parameters as at a point 7 and a partially condensed working fluid stream 27 having parameters as at a point 21. In the preferred embodiment of this system, the parameters of the streams 118 and 124 having the parameters as at the points 6 and 7, respectively, are identical or close to identical, where close to identical means that the parameters of each of the stream 118 and 124 are with about 5% of each other.

Thereafter, the basic solution streams 118 and 124 having parameters as at the points 6 and 7, respectively, are combined forming a stream 29 having parameters as at a point 8. The parameters of the stream 128 are such that the stream 128 is generally in a state of a liquid-vapor mixture. The stream 128 having the parameters as at the point 8 is then sent through a seventh heat exchanger HE7, where it is further heated and vaporized in counterflow with a third cooled heat source fluid steam 31 having parameters as at a point 46 in a fourth heat exchange process 46-42 or 8-14 as described below. The fourth heat exchange process 46-42 produces a first mixed stream 33 having parameters as at a point 14 and a fifth cooled heat source stream 116 having parameters as at a point 42. In the preferred embodiment of this system, the parameters of the basic working fluid stream 132 is such that the stream 132 is either in a state of saturated vapor, i.e., fully vaporized, or has some very small amount wetness generally less than about 5% wetness.

Thereafter, the stream 132 having the parameters as at the point 14 is combined with a liquid stream 37 having parameters as at a point 29, forming a working solution stream 39 having parameters as at a point 10. The stream 136 having the parameters as at the point 29 is referred to herein as a recirculating solution. The parameters of the stream 136 at the point 29 is such that the stream 136 is in a state of saturated or slightly subcooled liquid as described below. The working solution stream 138 having the parameters as at the point 10 then passes though a fifth heat exchanger HE5, where it is heated and vaporized in counterflow with a first cooled heat source fluid stream 41 having parameters as at a point 41 in a fifth heat exchange process 41-44 or 10-11 as described below. The fifth heat exchange process 41-44 produces a second mixed stream 43 having parameters as at a point 11 and a second cooled heat source stream 45 having the parameters as at a point 44.

In the preferred embodiment of this system, the parameters of the stream 142 at the point 11 is such that the stream 142 is in a state of a saturated vapor. The stream 142 having the parameters as at the point 11 is sent into a sixth heat exchanger HE6, where it is superheated in counterflow with a heat source fluid stream 47 having parameters as at a point 40 in a sixth heat exchange process 40-41 or 11-17 as described below. The sixth heat exchange process 40-41 produces a fully vaporized and superheated stream 49 having obtains parameters as at a point 17 and the first cooled heat source stream 140 having the parameters as at the point 41. The stream 148 having the parameters as at the point 17 then enters a turbine T1, where it is expanded, producing power, and the spent stream 122 having parameters as at a point 20.

The spent stream 122 having the parameters as at the point 20 is then sent into the third heat exchanger HE3, where it is cooled and partially condensed, releasing heat for the third heat exchange process 20-21 as described above forming the stream 126 having the parameters as at the point 21. The parameters of the stream 126 at the point 21 is in a state of a vapor-liquid mixture. The stream 126 with parameters as at point 21 then enters into a separator S1, where it is separated into a saturated vapor stream 51 having parameters as at a point 22, and a saturated liquid stream 53 having parameters as at a point 23. The concentration of a low boiling component in the vapor stream 150 having the parameters as at the point 22 must be higher or equal to the concentration of the low boiling component in the basic working solution as described above.

The liquid stream 152 having the parameters as at the point 23 is divided into two substreams 55 and 57 having parameters as at points 24 and 25, respectively. The liquid stream 156 having the parameters as at the point 25 is then combined with the vapor stream 150 having the parameters as at the point 22, forming a basic working solution stream 106 having the parameters as at the point 26. The stream 106 of basic working solution having the parameters as at the point 26 then passes through the recuperative pre-heater or second heat exchanger HE2, where it is cooled and partially condensed, releasing heat for process 2-3 or 26-27 as described above becoming the stream 110 having parameters as at point 27.

The stream 110 of basic working solution with parameters as at point 27 is then sent through a condenser or first heat exchanger HE1, where it is cooled and fully condensed, in counterflow with a stream 59 of coolant (air or water) stream having parameters as at a point 50 in a seventh heat exchange process 50-51 or 27-1. The seventh heat exchange process 50-51 produces a spent coolant stream 61 having parameters as at a point 51 and the stream 102 having parameters as at the point 1 as described above.

The stream 154 of liquid with the parameters as at the point 24 as described above enters into a second pump P2, where its pressure is increased to form a higher pressure stream 63 having parameters as at a point 9. The parameters of the stream 162 are such that the stream 162 correspond to a state of subcooled liquid. The stream 162 having the parameters as at point 9 then passes through an eighth heat exchanger HE8, where it is heated in counterflow with a fourth cooled heat source fluid stream 65 having parameters as at a point 47 in an eighth heat exchange process 47-48 or 9-29 described below. The eighth heat exchange process 47-48 produces a seventh cooled heat source stream 67 having parameters as at a point 48 and the stream 136 having the parameters as at the point 29. The parameters of the stream 136 are such that the stream 136 corresponds to a state of saturated or slightly subcooled liquid. Thereafter, the stream 136 having the parameters as at the point 29 is combined with the stream 132 having the parameters as at the point 14, forming the stream 138 having the parameters as at the point 10 as described above.

The heat source fluid stream 146 having the initial parameters as at the point 40, passes through the sixth heat exchanger HE6, where it is cooled, providing heat for process 11-17 as described above forming the first cooled heat source stream 140 having the parameters as at the point 41. Thereafter, the first cooled heat source stream 140 having the parameters as at the point 41 passes through the fifth heat exchanger HE5, where it is cooled, providing the fifth heat exchange process 10-11 as described above forming the stream 144 having the parameters as at the point 44. Thereafter, the stream 144 of heat source fluid having the parameters as at the point 44 is divided into two substreams 130 and 164 having the parameters as at the points 46 and 47, respectively.

The stream 130 having the parameters as at the point 46 passes through the seventh heat exchanger HE7, where it is cooled, providing heat for the fourth heat exchange process 8-14 as described above to form the fifth cooled heat source stream 116 having the parameters as at the point 42. The stream 116 of heat source fluid having the parameters as at the point 42 then passes through the fourth heat exchanger HE4, where it is further cooled, providing heat for the second heat exchange process 4-6 as described above to form the sixth cooled heat source stream 120 having the parameters as at the point 43.

The stream 164 of heat source fluid having the parameters as at the point 47 passes through the eighth heat exchanger HE8, where it is cooled, providing heat for the eighth heat exchange process 9-29 as described above to form the seventh cooled heat source stream 166 having the parameters as at the point 48. Thereafter, the sixth cooled heat source streams 120 and the seventh cooled heat source 166 of heat source fluid having the parameters as at the points 43 and 48 are combined, forming a spent heat source stream 69 having parameters as at a point 49 which is sent out of the system.

The cycle is closed.

The complete vaporization of the basic solution and the preheating of the recirculating solution prior to the combination of the basic solution with the recirculating solution reduces the irreversibility in the process of mixing of these two streams and therefore increases the efficiency of the overall process. Moreover, this approach increases the heat load in the process cooling the heat source fluid from point 44 down. This, in turn, requires an increase of a flow rate of the heat source fluid per unit of a flow rate of the basic solution. As a result, a flow rate of the recirculating solution can also be increased leading to an increase of a flow rate of the working solution passing through the turbine, and thus an increase in a power output. At the same time, a flow rate of the basic solution passing through the final condenser or first heat exchanger HE1 of the seventh heat exchange process 27-1, remains unchanged, and a quantity of heat rejected in the first heat exchanger HE1 also remains unchanged. As a result, the overall efficiency of the system is increased.

A summary of a performance of the system of this invention is presented in Table 1 and the parameters of all key points described above are tabulated in Table 2.

Comparing these results with the results of the system presented in the prior art shows that the system of this invention within a temperatures range between about 325° F., and about 500° F. has a net thermal efficiency that is from 7% to 10% higher than the efficiency of the system presented in the prior art.

TABLE 1

| Plant Performance Summary | | | | |
|---|---|---|---|---|
| Heat in | 30,470.49 | kW | 538.65 | Btu/lb |
| Heat rejected | 24,800.44 | kW | 438.41 | Btu/lb |
| Turbine enthalpy Drops | 5,803.26 | kW | 102.59 | Btu/lb |
| Gross Generator Power | 5,533.70 | kW | 97.82 | Btu/lb |
| Process Pumps (−2.35) | −144.79 | kW | −2.56 | Btu/lb |
| Cycle Output | 5,388.91 | kW | 95.26 | Btu/lb |
| Other Pumps and Fans (−2.25) | −136.61 | kW | −2.41 | Btu/lb |
| Net Output | 5,252.30 | kW | 92.85 | Btu/lb |
| Gross Generator Power | 5,533.70 | kW | 97.82 | Btu/lb |
| Cycle Output | 5,388.91 | kW | 95.26 | Btu/lb |
| Net Output | 5,252.30 | kW | 92.85 | Btu/lb |
| Net thermal efficiency | | | 17.24% | |
| Second Law Limit | | | 29.50% | |
| Second Law Efficiency | | | 58.43% | |
| Specific Brine Consumption | | | 95.20 | lb/kW-hr |
| Specific Power Output | | | 10.50 | W-hr/lb |

| Overall Heat Balance Btu/lb | |
|---|---|
| Heat In: | Source + pumps = 538.65 + 2.35 = 541.00 |
| Heat Out: | Turbines + condenser = 102.59 + 438.41 = 541.00 |

TABLE 2

Parameters of Key Points

Working Fluid

| Pt. | X lb/lb | T ° F. | P psia | H Btu/lb | S Btu/lb-R | Ex Btu/lb | G rel G/G = 1 | Ph. lb/lb | Wetness or T ° F. |
|---|---|---|---|---|---|---|---|---|---|
| 1 | 0.9000 | 69.81 | 115.587 | 8.7511 | 0.0717 | 53.6564 | 1.00000 | Mix | 1 |
| 2 | 0.9000 | 71.09 | 474.724 | 10.8310 | 0.0725 | 55.3018 | 1.00000 | Liq | −95.67° F. |
| 3 | 0.9000 | 165.00 | 464.724 | 121.8394 | 0.2649 | 67.9204 | 1.00000 | Mix | 1 |
| 4 | 0.9000 | 165.00 | 464.724 | 121.8394 | 0.2649 | 67.9204 | 0.39329 | Mix | 1 |
| 5 | 0.9000 | 165.00 | 464.724 | 121.8394 | 0.2649 | 67.9204 | 0.60671 | Mix | 1 |
| 6 | 0.9000 | 227.47 | 462.724 | 533.3776 | 0.9076 | 150.7830 | 0.39329 | Mix | 0.1799 |
| 7 | 0.9000 | 227.47 | 462.724 | 533.3776 | 0.9076 | 150.7830 | 0.60671 | Mix | 0.1799 |
| 8 | 0.9000 | 227.47 | 462.724 | 533.3778 | 0.9076 | 150.7830 | 1.00000 | Mix | 0.1799 |
| 9 | 0.3811 | 170.79 | 464.724 | 48.6950 | 0.2189 | 15.9998 | 0.17026 | Liq | −114.35° F. |
| 10 | 0.8245 | 284.57 | 462.224 | 606.6533 | 1.0093 | 171.7561 | 1.17026 | Mix | 0.1686 |
| 11 | 0.8245 | 322.52 | 460.724 | 757.8078 | 1.2073 | 221.6375 | 1.17026 | Vap | −0.1° F. |
| 14 | 0.9000 | 284.57 | 462.224 | 679.1791 | 1.1111 | 192.5432 | 1.00000 | Mix | 0.0271 |
| 17 | 0.8245 | 361.00 | 460.224 | 784.8355 | 1.2411 | 231.3555 | 1.17026 | Vap | 38.6° F. |
| 20 | 0.8245 | 232.47 | 121.587 | 697.1728 | 1.2635 | 132.2385 | 1.17026 | Mix | 0.0442 |
| 21 | 0.8245 | 170.00 | 119.587 | 483.8153 | 0.9440 | 82.2867 | 1.17026 | Mix | 0.2499 |
| 22 | 0.9722 | 170.00 | 119.587 | 629.3327 | 1.1858 | 104.8123 | 0.87779 | Mix | 0 |
| 23 | 0.3811 | 170.00 | 119.587 | 47.0820 | 0.2183 | 14.6817 | 0.29247 | Mix | 1 |
| 24 | 0.3811 | 170.00 | 119.587 | 47.0820 | 0.2183 | 14.6817 | 0.17026 | Mix | 1 |
| 25 | 0.3811 | 170.00 | 119.587 | 47.0820 | 0.2183 | 14.6817 | 0.12221 | Mix | 1 |
| 26 | 0.9000 | 170.00 | 119.587 | 558.1742 | 1.0676 | 93.7972 | 1.00000 | Mix | 0.1222 |
| 27 | 0.9000 | 112.84 | 117.587 | 447.1658 | 0.8843 | 76.5215 | 1.00000 | Mix | 0.2273 |
| 29 | 0.3811 | 284.57 | 462.224 | 180.6858 | 0.4111 | 49.6667 | 0.17026 | Mix | 1 |

Heat Source

| Pt. | X lb/lb | T ° F. | P psia | H Btu/lb | S Btu/lb-R | Ex Btu/lb | G rel G/G = 1 | Ph. lb/lb |
|---|---|---|---|---|---|---|---|---|
| 40 | BRINE | 370.00 | 14.693 | 352.5340 | 0.5047 | 94.4232 | 2.58868 | Liq |
| 41 | BRINE | 358.29 | 14.693 | 340.3156 | 0.4899 | 89.7893 | 2.58868 | Liq |
| 42 | BRINE | 234.59 | 14.693 | 211.2994 | 0.3189 | 48.2247 | 2.40263 | Liq |

TABLE 2-continued

| Parameters of Key Points | | | | | | | | |
|---|---|---|---|---|---|---|---|---|
| 43 | BRINE | 170.00 | 14.693 | 143.9340 | 0.2171 | 32.9407 | 2.40263 | Liq |
| 44 | BRINE | 292.77 | 14.693 | 271.9834 | 0.4028 | 65.9851 | 2.58868 | Liq |
| 46 | BRINE | 292.77 | 14.693 | 271.9834 | 0.4028 | 65.9851 | 2.40263 | Liq |
| 47 | BRINE | 292.77 | 14.693 | 271.9834 | 0.4028 | 65.9851 | 0.18605 | Liq |
| 48 | BRINE | 176.96 | 14.693 | 151.1910 | 0.2285 | 34.3364 | 0.18605 | Liq |
| 49 | BRINE | 170.50 | 14.693 | 144.4556 | 0.2179 | 33.0388 | 2.58868 | Liq |

| Coolant | | | | | | | | | |
|---|---|---|---|---|---|---|---|---|---|
| Pt. | X lb/lb | T ° F. | P psia | H Btu/lb | S Btu/lb-R | Ex Btu/lb | G rel G/G = 1 lb/lb | Ph. | T ° F. |
| 50 | water | 51.70 | 54.693 | 19.9395 | 0.0394 | 0.1617 | 15.6119 | Liq | −235 |
| 51 | water | 51.81 | 64.693 | 20.0833 | 0.0397 | 0.1914 | 15.6119 | Liq | −245.84 |
| 52 | water | 79.92 | 54.693 | 48.1655 | 0.0932 | 0.9127 | 15.6119 | Liq | −206.78 |

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

The invention claimed is:

1. A method comprising the steps of:

transforming a portion of thermal energy in a superheated vapor stream into usable energy to produce a spent stream;

transferring thermal energy from an external heat source stream to a first vapor stream to form the superheated vapor stream and a first cooled external heat source stream;

transferring thermal energy from the first cooled external heat source stream to a first mixed stream to form the first vapor stream and a second cooled external heat source stream;

transferring thermal energy from the spent stream to a first pre-heated higher pressure, basic working fluid substream to form a partially condensed spent stream and a first heated, higher pressure, basic working fluid substream;

transferring thermal energy from a third cooled external heat source substream to a second pre-heated higher pressure, basic working fluid substream to form a second heated, higher pressure, basic working fluid substream and a first cooled external heat source substream;

combining the first and second heated, higher pressure basic working fluid substreams to form a combined heated, higher pressure basic working fluid stream;

transferring thermal energy from a first portion of the second cooled external heat source stream to the combined heated, higher pressure basic working fluid stream to form a higher temperature, higher pressure, basic working fluid stream and the third cooled external heat source substream;

separating the partially condensed spent stream into a separated vapor stream and a separated liquid stream;

pressurizing a first portion of the separated liquid stream to a pressure equal to a pressure of the combined higher temperature, higher pressure basic working fluid stream to form a pressurized liquid stream;

transferring thermal energy from a second portion of the second cooled external heat source stream to the pressurized liquid stream to form a second mixed stream and a fourth cooled external heat source substream;

combining the second mixed stream with the combined higher temperature, higher pressure basic working fluid stream to form the first mixed stream;

combining a second portion of the separated liquid stream with the separated vapor stream to from a lower pressure, basic working fluid stream;

transferring thermal energy from the lower pressure, basic working fluid stream to a higher pressure, basic working fluid stream to form a pre-heated, higher pressure, basic working fluid stream and a cooled, lower pressure, basic working fluid stream;

transferring thermal energy from the cooled, lower pressure, basic working fluid stream to an external coolant stream to from a spent external coolant stream and a fully condensed, lower pressure, basic working fluid stream; and pressurizing the fully condensed, lower pressure, basic working fluid stream to the higher pressure, basic working fluid stream.

* * * * *